United States Patent [19]

Hofsäss

[11] Patent Number: 5,046,156

[45] Date of Patent: Sep. 3, 1991

[54] TEMPERATURE SWITCH WITH A BIMETALLIC SWITCH MECHANISM

[76] Inventor: Peter Hofsäss, Strietweg 45, D-7530 Pforzheim, Fed. Rep. of Germany

[21] Appl. No.: 554,921

[22] Filed: Jul. 20, 1990

[30] Foreign Application Priority Data

Jul. 25, 1989 [DE] Fed. Rep. of Germany ... 8908999[U]
Dec. 23, 1989 [DE] Fed. Rep. of Germany ... 8915123[U]

[51] Int. Cl.[5] ..... H01H 37/04; H01H 37/52
[52] U.S. Cl. ..... 337/380; 310/68 C
[58] Field of Search ..... 361/400, 401, 402, 403, 361/404, 405, 417; 337/372, 380; 310/68 C

[56] References Cited

U.S. PATENT DOCUMENTS 3,772,632 11/1973 Rattcliff et al. ..... 361/403
4,268,812 5/1981 Satterlee ..... 337/380
4,446,451 5/1984 Boulanger ..... 337/380

*Primary Examiner*—Harold Broome
*Attorney, Agent, or Firm*—Antonelli, Terry, Stout & Kraus

[57] ABSTRACT

In order to improve the handling of a temperature switch, particularly for the use and contacting thereof on a printed circuit board, the invention provides a temperature switch, such as in particular a thermostat for an electric motor with a bimetallic switch mechanism in a casing, in which the latter is provided with a shoulder having undercuts and that connecting contacts are arranged adjacent to the shoulder.

20 Claims, 2 Drawing Sheets

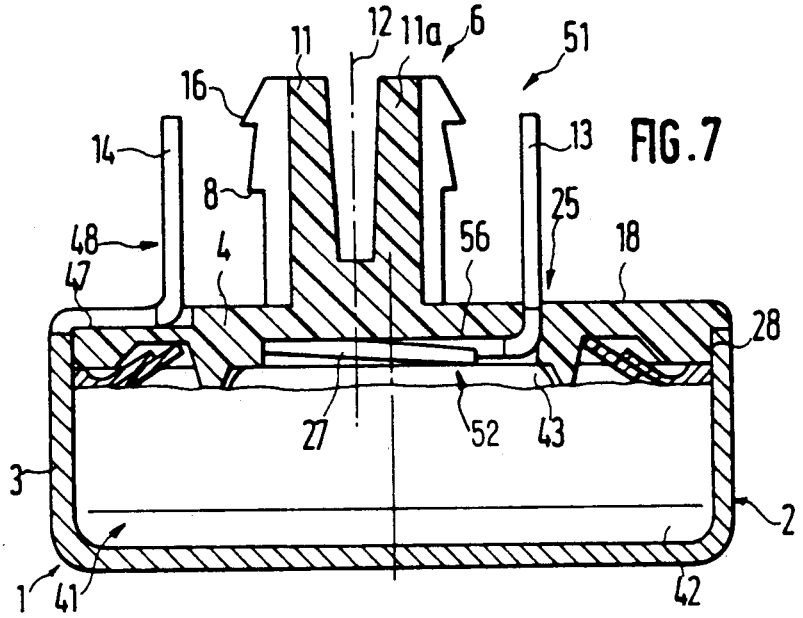
FIG.7
FIG.8
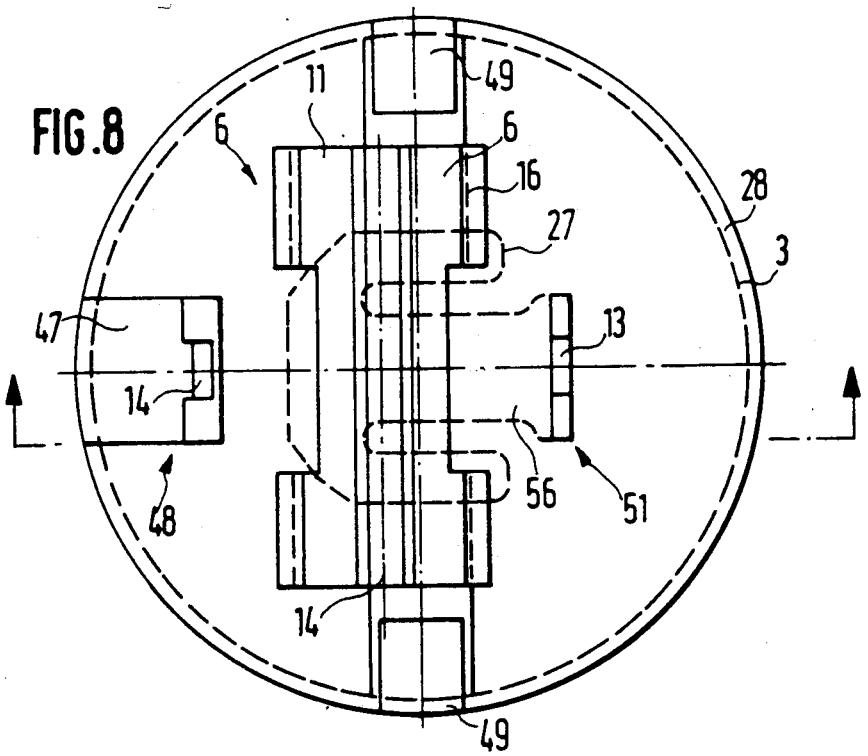

TEMPERATURE SWITCH WITH A BIMETALLIC SWITCH MECHANISM

FIELD OF THE INVENTION

The invention relates to a temperature switch, such as in particular a thermostat for an electric motor with a bimetallic switch mechanism in a casing.

BACKGROUND OF THE INVENTION

For many purposes in particular electric motors must be protected against excessive currents or temperatures. For this purpose temperature switches with bimetallic switch mechanisms are used, which are fixed in the circuit of the electric motor on a contact thereof and in particular on the printed circuit board provided with conducting tracks to be fixed to its stator. This is brought about in that the flexible leads of the temperature switch are bent over optionally after passing through cutouts in the printed circuit board and are soldered flat to the corresponding conducting tracks on said board. This process has to be performed manually. The printed circuit board is subsequently placed on a lateral shoulder of the electric motor stator, the bimetallic switch being located between the board and the motor winding. In this area the windings must be pressed to the side, so as to permit correct mounting of the printed circuit board. However, it often arises that it is not precisely perpendicular, but displaced with respect to the rotation axis, because it is pressed to the side at the location of the bimetallic switch. The latter often has a convexity or bulge as a result of the sealing compound and is consequently also not parallel to the printed circuit board and is instead tilted with respect thereto, also as a result of one-sided tension due to the soldering to the leads.

SUMMARY OF THE INVENTION

The aim underlying the present invention essentially resides in providing a temperature switch whose use and contacting can largely be automated while avoiding the disadvantage encountered in the prior art.

According to the invention a temperature switch, particularly for protecting electric motors on a printed circuit board for the electric motor, with a bimetallic switch and a casing, is characterized in that the casing is provided with a shoulder having undercuts and that connecting contacts are positioned parallel to the shoulder.

As a result of the shoulder provided with undercuts the electrical contact is separated from the mechanical connection of the switch to the printed circuit board, whereas in the prior art the mechanical connection and the electrical contact took place together via the leads to be bent over and connected. Thus, in a first step the switch is merely mounted on the printed circuit board, either perpendicular thereto or through laterally open slots in the plane thereof, so that initially the mechanical connection is obtained. Subsequently and as a result of the clearly defined connecting contacts and also in an automated manner the electrical contacting of the said contacts to the printed circuit boards is brought about by soldering points.

The inventive temperature switch can be connected fully automatically to an electric mounting plate to which it is reliably fixed and in particular the further electrical connections can be produced fully automatically and as a result of the component formed by said mounting plate and the temperature switch can be handled easily for further processing purposes.

As a result of the inventive construction of the temperature switch the latter can initially be handled as a component and can e.g. be supplied from a vibrating container to an automatic insertion machine, which presses its connecting shoulder automatically through a corresponding opening in a mounting plate and consequently reliably fixes the switch to the latter. In the same way and also through corresponding openings on the mounting plate, the terminal lugs are forced through the same, so that after fixing the switch to the plate in the aforementioned manner it is possible to easily bring about in fully automatic manner the electrical connection between the terminal lugs and the conducting tracks on the said plate by the provision of soldering points. The component combined from the mounting plate and the inventive temperature switch can then be further dealt with as loose or bulk material and supplied for further processing.

According to preferred developments the casing has an electrically conductive casing base and a cover part made from electrically insulated material or the shoulder is provided with a longitudinally extending slot projecting from the outside to the inside and whose lateral boundary regions form spring portions.

According to a further preferred development of the inventive switch the connecting shoulder extends at right angles to the surface of the cover part of the outer casing and in particular connecting legs extend parallel to the shoulder for electrical contacting purposes.

A further development is characterized in that the container part of the outer casing has a connecting leg constructed in one piece therewith and the connecting leg is connected in one piece to the container part of the outer casing by means of a connecting portion partly bent over the cover part.

The spring part is constructed in such a way that, besides the connecting leg projecting through the opening or cutout of the cover part of the outer casing, it has a connecting portion at right angles thereto within said casing and on whose end opposite to the connecting leg are constructed spring legs in one piece with the connecting portion and which can easily be bent out of the connecting portion plane.

According to further developments, the connecting shoulder is provided with a slot between two legs and that the undercuts are formed by two-step noses, which are arranged with different spacings relative to the surface of the cover part of the outer casing and in particular with the container part of the latter via the cover part are constructed lugs pressing the same against the faces of the container part.

In a preferred manner the casing is provided with a shoulder extending substantially at right angles from its surface and which has undercuts and that connecting contacts extend parallel to the shoulder. The shoulder can also be provided with a slot projecting from the outside to the inside in the longitudinal direction thereof and whose lateral boundary regions form spring portions. According to preferred developments the shoulder is made from plastic and in particular, optionally together with the cover, is a plastic injection moulding and the casing base is a deep-drawn metal part. In the latter case a connecting contact is constructed in one piece on the casing base, said contact being cut out of projections of the deep-drawn casing base. These production steps are substantially or completely automatable, which leads to considerable manufacturing advantages. The casing base and cover can be connected in that the cover is held or retained by bent over retaining lugs of the casing base and in particular in that a connecting contact is constructed as a retaining lug and extends radially inwards over the cover from the outer casing edge and is then bent away upwards at right angles from the cover.

Whilst the switch mechanism can be inserted as such in the casing base with a fluid-tight seal being provided between said base and said cover, according to a highly preferred development the bimetallic switch mechanism is arranged with its own (inner) casing in the (outer) casing. The aforementioned temperature switch casing in this case merely serves as an outer casing and in it is inserted a conventional switch mechanism completely encapsulated or protected in an inner casing and which can result from the mass production of such switch mechanisms. It need not, as is usually the case, be provided with leads, but is directly inserted as such in the outer casing base and the inner casing has a container and a cover part insulated therefrom, both being made from metal. This construction offers the further advantage that the second contacting can be simplified besides that provided by the inner casing container and the outer casing base and a connecting contact preferably constructed in one piece therewith. According to a particularly preferred embodiment a connecting contact is constructed in one piece with a spring part, which resiliently engages between the outer casing cover and the inner casing and said spring part is formed by spring lugs bent away out of the plane of a connecting web. After the insertion of the switch mechanism with the inner casing in the outer casing base, it is merely necessary to engage the connecting contact provided with the spring portion on the cover part of the inner casing, optionally after it has been inserted through it with the contact part from the inside of the outer casing cover. The outer casing cover is then mounted and secured in the aforementioned manner by the retaining lugs to be bent over.

Whereas the hitherto described temperature switch can be advantageously fixed in the described manner as such and in conjunction with other parts, particularly to conventional printed circuit boards, which are optionally provided with electronic components, according to further preferred developments the undercut shoulder engages positively on a circular printed circuit board, which has conducting tracks insulated from one another. In the vicinity of at least two not electrically conductively connected conducting tracks the printed circuit board has in each case a cutout with a spacing corresponding to that of the connecting contacts and between the cutouts is formed a slot, whose width corresponds to that of an undercut web of the shoulder and in particular the slot is oriented at right angles to the radius of the printed circuit board. From the outside of the printed circuit board extend radially parallel slots, in whose centre engages the shoulder with a web, the connecting contacts projecting through the outer slots.

Thus, the invention provides a temperature switch, which can be fully automatically mechanically and electrically connected to printed circuit boards in such a way that no longer is any manual work required. In addition, the manufacture of the inventive temperature switch is simplified and can be automated, because it is no longer necessary to solder or weld in manual manner any leads thereto. Instead the few components of said temperature switch can be automatically and separately fed to one another, in that the outer casing container is supplied by means of a conveying mechanism, such as a conveying chain. To the same is also supplied in automatic manner from a vibrating container the switch mechanisms provided with the inner casing by merely shaking in. They are then taken up by the corresponding working mechanism and inserted in the container part. The spring part and the cover part of the outer casing are then fitted and finally the lugs of the outer casing container part and the connecting lugs or more precisely the connection thereto are bent over the cover part. As a result the latter is pressed against the faces of the container part and simultaneously the spring part is tensioned, so that between the inner casing cover and the connecting leg projecting out of the outer casing cover part an electrical connection is reliably produced.

Further advantages and features of the invention can be gathered from the claims and description relative to an embodiment of the invention and the attached drawings, wherein show:

BRIEF DESCRIPTION OF THE DRAWINGS

FIG. 7 is a larger-scale view of a switch similar to that of FIG. 1 with partly broken away areas.

FIG. 8 is a plan view of the switch of FIG. 7.

DETAILED DESCRIPTION

The inventive temperature switch 1 has an (outer) casing 2 with a casing base 3 and a casing cover part 4. Casing 2 houses the bimetallic switch mechanism (not shown in detail), which can additionally be inserted (cf. hereinafter) as a complete switch mechanism, encapsulated in an inner casing, in the outer casing 2, but this need not be the case. The open switch mechanism could also be housed in the casing 2, which would then form the only casing of the switch mechanism.

Figure 4:
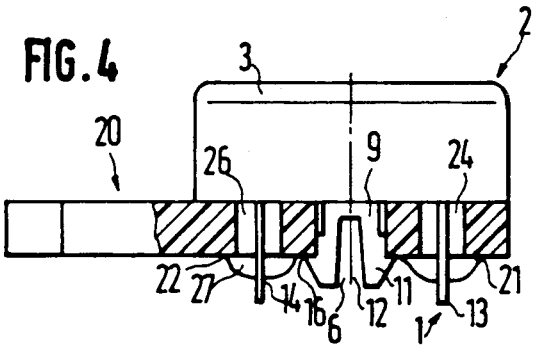
FIG. 4 is a partial section corresponding to IV—IV in FIG. 3.

From the cover part 4 extends vertically upwards a fixing, connecting or retaining shoulder 6, which has two spring legs 11, 11*a* separated by a slot 12. The said legs are provided with undercuts 7, which are spaced from the cover surface of the cover part 4 on the retaining shoulder 6 by retaining noses 16 and project laterally over a web part 9 of shoulder 6. Between the noses 16, 17 are provided recesses 10. in order to be able to better apply solder points 27 to connecting parts 51. The slot 12 extending longitudinally between the legs 11 and extending from the outside to the inside perpendicular to the cover surface of cover 4 gives the resilient characteristics to the spring legs 11, 11*a*. At a distance from the retaining shoulder 6 and at right angles to the cover surface of the cover 4 extend connecting lugs 13, 14, which are made from a dimensionally stable metal. Switch 1 is fixed according to FIGS. 4 to 6 to a circular printed circuit board 20 for an electric motor. The circuit board 20 has one or more conducting tracks 21, 22, which generally extend only over a partial circumference of circuit board 20 and are not electrically in direct contact. The conducting tracks are used for contacting or connecting coil windings, in that the coil ends are connected to the corresponding tracks, generally by solder contacting, which are in turn connected by soldering to connecting cables by means of which the motor is connected to the power supply. The coil ends are passed through bores or lateral slots from the side of the printed circuit board 20 remote from the conducting tracks 21, 22 to the side of the latter. The connecting cables are passed towards and away from the printed circuit board in the vicinity of a pitch circular outer recess through said adjacent bores, followed by soldering, which leads to a certain tension relief.

Figure 3:
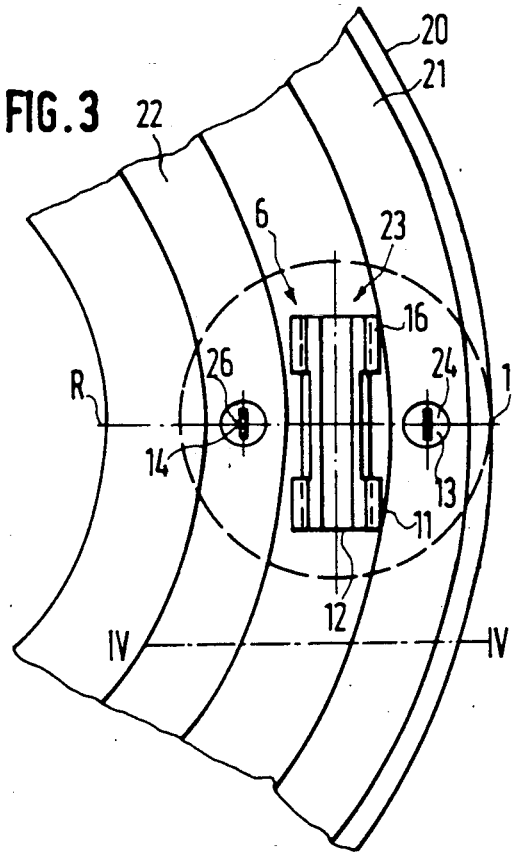
FIG. 3 is a detail of a circular printed circuit board for an electric motor with a switch according to FIG. 1 placed below it.

The printed circuit board 20 of FIG. 3 has between the two parallel, spaced conducting tracks 21, 22 a slot 23 extending at right angles to the radius R and whose length corresponds to that of the shoulder 6 and whose width corresponds to that of the web 9 of the shoulder 6.

Bores 24, 26 are provided on either side of and spaced with respect to the slot 23. The switch 1 is positively fixed to the printed circuit board 20, in that the retaining shoulder 6 is passed through the slot 23 by its spring portions tapering conically to its free end until the members 8 engage behind the printed circuit board 20, snap over the edges of the slot 23 and in this way fix the switch 1 on the printed circuit board 20. Simultaneously the connecting contacts 13, 14 are led through the cutouts 24, 26 and extend through the same. The contacts 13, 14 are subsequently connected by soldering 27 to the conducting tracks 21, 22 (FIG. 4, not shown in FIG. 3 so as not to overburden the representation).

This process can take place completely automatically as opposed to the individual fixing of the bimetallic switch leads according to the prior art, where manual work is needed.

Figure 5:
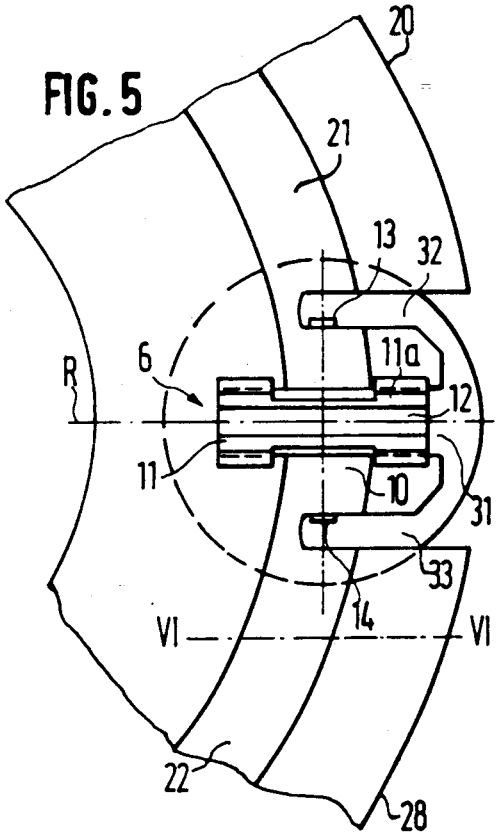
FIG. 5 is a partial view of a corresponding circular printed circuit board with a radial slot and a switch retaining shoulder inserted therein.
Figure 6:
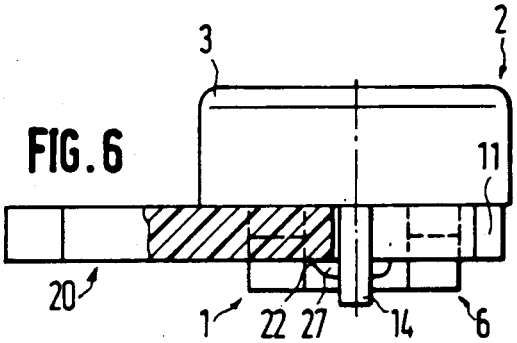
FIG. 6 is a sectional representation corresponding to FIG. 4 for the construction of FIG. 5.

In the construction according to FIGS. 5 and 6 three parallel slots 31, 32, 33 are provided in the circuit board free from its outer edge 28 and whereof the central one has a length substantially corresponding to that of the retaining shoulder 6 and whose width corresponds to that of the web 9 of shoulder 6, whilst the slots 32, 33 on either side of the slot 31 are positioned at a spacing substantially corresponding to the spacing of the connecting contacts 13, 14 of the switch 1 with respect to the shoulder 6. In this construction in the vicinity of the slot 31, the circuit board 20 is so inserted between the casing 2 and the members 8 on the shoulder 6 of the switch 1, that the web 9 of shoulder 6 engages in the slot 31, whilst the contacts 13, 14 project through the slots 32, 33. The connecting contacts 13, 14 are located in the vicinity of the conducting tracks 21, 22, which are located on the same circular periphery here, but are electrically separated from one another by the slot 31. Once again it is possible to provide solder points 27 for the electrical connection of connections 13 or 14 to the conducting tracks 21 or 22.

FIGS. 7 and 8 show a preferred development of the inventive temperature switch in a part sectional representation. In FIGS. 7 and 8 said temperature switch 1 also has in per se known manner a bimetallic switch mechanism arranged in an inner casing 41 and which can be constructed in different ways.

The inner casing 41 comprises a container part 42 and a cover part 43, which are electrically separated from one another by an insulation 44, e.g. insulating material films or layers. The container part 42 and the cover part 43 are firmly interconnected by a crimped over edge 46 of part 42, which is insulated from the cover part 43 by insulation. The container part 3 and cover part 4 are electrically conductive and are in each case electrically connected to one of the two contactable contact parts of the bimetallic switch mechanism in the interior of the casing 41, so that they form the two terminals for the bimetallic switch mechanism. According to the invention the inner casing 41 is inserted in an outer casing 2. The outer casing 2 has a base 3 and a cover part 4.

Figure 1:
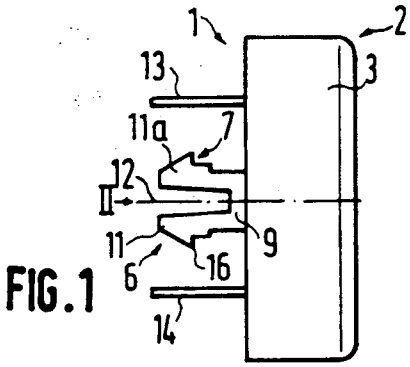
FIG. 1 is a preferred embodiment of an inventive temperature switch in side view corresponding to arrow I of FIG. 2.
Figure 2:
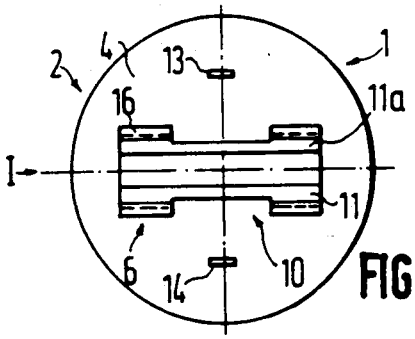
FIG. 2 is a plan view of the switch of FIG. 1 corresponding to arrow II therein.

The casing base 3 is made from electrically conductive material, e.g. steel. The cover part 4 is made from an insulating material, such as a high temperature-resistant plastic or the like. The cover part 4 is here again provided with a fixing or retaining shoulder 6, which is provided between two legs 11, 11*a*, which are homologous to one another, has a slot 12, which permits a certain elasticity of the legs 11, 11*a* at right angles to their extension direction. The legs 11, 11*a* are provided with noses 16, 17 enabling them to engage behind electrical circuit boards with different thicknesses, namely on the one hand with a thickness corresponding to the spacing of the nose 16 from the outer cover surface 18 of the cover part 4 and on the other hand a circuit board with a smaller thickness corresponding to the spacing of nose 17 from the outer cover surface 18 of the cover part 4. In addition, at a distance from the shoulder 6 in the cover part 4 is formed a cutout 24, through which projects the connecting leg or contact 13 of a connecting part or contact spring part 52. The contact spring or connecting part 51 has, besides the connecting leg 13, a leafspring part 52, which is formed by a connecting web 56 to the connecting leg 13 and the spring legs 52, which are constructed in one piece with web 56 at the end opposite to the connecting leg and are somewhat bent out of the plane of web 56. The connecting leg 13 extends substantially at right angles to the connecting web 56. As a result of this construction the spring part 51 with its spring legs 53 and the connecting web 56 can be positioned between the cover part 43 of the inner casing and the cover part 4 of the outer casing 2, the connecting leg 13 projecting through the cutout 24 towards the outside of the cover part 4. By pressing the cover part 4 against the front edge 46 of the container part 3 of the outer casing 2 and therefore against the cover part 43 of the inner casing 41, the spring part 51 with its spring legs 53 is firmly pressed against the conductive cover part 43 of the inner casing 41, so that a reliable electrical contact is formed between the conductive cover part 43 of the inner casing 41 and the spring part 51, so that the latter can be used for contacting on the contact leg 22. The pressing pressure for the cover part 4 is on the one hand provided by lugs 49 constructed in one piece on the upper edge 46 of the container part 3 and which are bent over the cover part 4 under said pressure and as can in particular be gathered from FIG. 2 and in addition a further connecting part 45 is constructed in one piece with container part 3 and which comprises a connecting part passing out directly at the upper edge 28 of part 3 and which also is bent horizontally over the cover part 4 and exerts a pressing pressure thereon. The connecting part 47 passes in one piece into the connecting leg 14 extending at right angles from the surface 18 of the cover part 9 and which is oriented parallel to the connecting leg 13. This makes it possible to produce the electrical contact via the connecting leg 14 for connecting part 47 to the conducting casing base of outer casing 2 and to the conductive container part 42 of the inner casing 41.

The inventive temperature switch is once again intended for use with a printed circuit board. The latter has in the vicinity of the connecting legs 13, 14 and the connecting shoulder 6 openings, whose length corresponds to the width of the legs 13, 14 or the shoulder 6 and whose width corresponds to the thickness of the legs 13, 14 or the shoulder 6 in its transition area to the cover part 4 and in particular is below the spacing of the facing noses 17 or 16 of the two members 12, 13.

Thus, the inventive temperature switch can be connected automatically, e.g. after supplying from a vibrating container, to a printed circuit board, in that the shoulder 6 and the connecting legs 13, 14 are inserted through the corresponding cutouts of the circuit board. The legs 11, 11*a* are slightly compressed until two noses 16, 17, after traversing the shoulder engage behind the printed circuit board and reliably fix the temperature switch thereto. Subsequently the circuit board provided with the switch can be easily handled as bulk material. Further contactings can also be carried out fully automatically, provided that the printed circuit board has conducting tracks, which terminate in the vicinity of the openings receiving the legs 13, 14 and at this point only electrical contact connections are produced by means of soldering points to the tracks of the circuit board.

This construction makes it possible to use conventional encapsulated bimetallic switch mechanisms, which are not yet provided with connecting cables, in that they are merely inserted in the outer casing 2, contacted in the described manner and then the casing is closed in the described way by mounting the cover and fixing the same to the base. These steps can also be performed largely or completely automatically.

The casing dimensions are only increased by a few fractions of a millimeter compared with the encapsulated switch mechanism. Alternatively the bimetallic switch mechanism can be inserted as such in the casing base 3 and then the latter can be closed in an appropriate way. In addition to the described construction, in particular in fluid-tight closure is to be ensured, as automatically occurs with encapsulated bimetallic switch mechanisms.

I claim:

1. Temperature switch for an electric motor, the temperature switch comprising a bimetallic switch means accommodated in an inner casing, an outer casing including an insulating cover part, a shoulder formed in one piece with said cover part, undercuts provided in said shoulder, connecting contacts positioned adjacent to said shoulder, and a spring means for resiliently engaging the cover part and the inner casing, wherein the spring means is constructed in one piece with one of said connecting contacts.

2. Switch according to claim 1, wherein said outer casing further includes an electrically conductive base.

3. Switch according to one of claims 1 or 2, wherein the shoulder includes a longitudinally extending slot means for forming a pair of spring legs.

4. Switch according to claim 3, wherein the cover part is fashioned as a plastic injection moulding.

5. Switch according to claim 2, wherein the electrically conductive base is fashioned of a deep-drawn metal part.

6. Switch according to claim 3, wherein another one of the connecting contacts is constructed in one piece with the electrically conductive base.

7. Switch according to claim 5, wherein said another one of the connecting contacts is cut from projections of the deep-drawn metal part forming the electrically conductive base.

8. Switch according to claim 6, wherein said another one of said connecting contacts is constructed as a retaining lug extending radially inwardly over the cover part from an outer edge of the outer casing and is then bent vertically upwardly from the cover part.

9. Switch according to claim 3, wherein the cover part includes a cutout, and wherein said one of said connecting contacts projects outwardly through the cutout.

10. Switch according to claim 3, wherein said spring means is formed by spring lugs bent out of a plane of the spring means.

11. Switch according to one of claims 1 or 2, wherein the undercut shoulder is adapted to positively engage on a printed circuit board having reciprocally insulated conducting tracks.

12. Switch according to claim 11 wherein the printed circuit board includes at least two non-electrically conductively interconnected conducting tracks, wherein a cutout is provided in a vicinity of the at least two non-electrically conductively interconnected conducting tracks at a spacing corresponding to a spacing between the connecting contacts, and wherein a slot is formed between the cutouts having a width corresponding to a width of an undercut web of the shoulder.

13. Switch according to claim 12, wherein the slot is oriented at right angles to a radius of the printed circuit board.

14. Switch according to claim 11, wherein the printed circuit board includes a plurality of parallel slots extending substantially radially from an outside of the printed circuit board, and wherein a central slot of said plurality of slots engages the web of the shoulder and the connecting contacts project through the remaining slots.

15. Switch according to one of claims 1 or 2, wherein the shoulder extends at right angles to an outer surface of the cover part.

16. Switch according to one of claims 1 or 2, wherein the connecting contacts extend parallel to the shoulder for enabling electrical connecting to a printed circuit board.

17. Switch according to one of claims 1 or 2, wherein said one of said connecting contacts projects through a cutout provided in the cover part and includes a connecting part having a spring leg forming a part of said spring means and constructed in one piece with a connecting portion arranged at right angles thereto within the outer casing and which can be easily bent out of a plane of the connecting portion.

18. Switch according to claim 1, wherein the shoulder is provided with a slot means for forming two legs.

19. Switch according to one of claims 1 or 2, wherein the undercuts are formed by two-step noses, which arranged at a spacing from an outer surface of the cover part.

20. Switch according to claim 3, wherein the switch is a thermostat.

* * * * *